United States Patent [19]

Rutgers

[11] 4,289,365

[45] Sep. 15, 1981

[54] DETACHABLE PLUG AND TRACK RECEPTACLE FOR ELECTRICAL CONNECTIONS

[75] Inventor: Hendrik J. Rutgers, Eindhoven, Netherlands

[73] Assignee: U.S. Philips Corporation, New York, N.Y.

[21] Appl. No.: 86,563

[22] Filed: Oct. 19, 1979

[30] Foreign Application Priority Data

Nov. 3, 1978 [NL] Netherlands ..... 7810941

[51] Int. Cl.[3] ..... H01R 25/14; H01R 41/00

[52] U.S. Cl. ..... 339/21 R

[58] Field of Search ..... 339/21 R, 21 S, 22 R, 339/22 B, 22 T

[56] References Cited

U.S. PATENT DOCUMENTS 3,015,795 1/1962 Meacham ..... 339/22 B 3,596,226 7/1971 Meltzer ..... 339/21 R

FOREIGN PATENT DOCUMENTS 2311687 9/1973 Fed. Rep. of Germany .... 339/22 R 1408605 10/1975 United Kingdom .

*Primary Examiner*—Neil Abrams

*Attorney, Agent, or Firm*—Marc D. Schechter

[57] ABSTRACT

A plug is coupled to a receptacle by means of a projecting rim on the base of the plug which engages a flange of the receptacle. The receptacle contains at least two electric current conductors extending in a longitudinal direction. Contact pins in the plug are mounted on a contact pin support which is spring loaded in the plug housing. The housing base can be inserted in the receptacle when the housing is oriented transverse to the longitudinal direction. Supporting blocks on the contact pin support then engage the flanges on the receptacle to cause the pins to recess in the housing against the spring forces. Upon rotating the housing 90°, the projecting rim of the base engages the flanges of the receptacle and the supporting blocks enter the receptacle, due to the springs, causing the contact pins to engage the current conductors.

13 Claims, 6 Drawing Figures

DETACHABLE PLUG AND TRACK RECEPTACLE FOR ELECTRICAL CONNECTIONS

BACKGROUND OF THE INVENTION

The invention relates to a combination of a plug, suitable for connection to a current-consuming device, for example a lamp, and a track receptacle having at least two mutually insulated current conductors. The plug is provided with at least two electrical contact pins for contacting the conductors in the receptacle and comprises a first part and a second part which is movable relative thereto. These parts are held in a first relative position by at least one spring. When the plug is coupled to the receptacle the force of the spring also provides the contact pressure between the contact pins and the current conductors. The receptacle encloses a space which is accessible via an opening extending in a longitudinal direction of the receptacle. The opening is bounded by two flanges. The plug includes electrically insulating supporting blocks arranged in such a manner that, when the plug is coupled to the voltage rail, these blocks are located between the facing edges of the two flanges and close fit each of two facing edges of the flanges in at least two different places.

Such a combination is disclosed, for example, in Netherlands Patent Application No. 7113699. An advantage of this known combination is that the moment of force which may be exerted by the current-consuming device connected to the plug is exerted only on the first part of the plug and the contact pressure between the contact pins and the current conductors obtained by spring action is not influenced by it. Furthermore, when the plug is coupled to the receptacle, the plug cannot be rotated about an axis perpendicular to the receptacle.

The disadvantage of the known combination is that upon coupling the plug to the receptacle, the contact pins can contact the current conductors before the current collector has reached its fixed final position with respect to the voltage rail.

SUMMARY OF THE INVENTION

In order to avoid this disadvantage, the invention provides a combination of the kind described above which is characterized in that upon coupling the plug to the track receptacle, the supporting blocks in the first relative position of the plug bear on or against the flanges of the receptacle and the first part of the plug includes a base member which can be inserted against the force of the spring into the space enclosed by the receptacle. Insertion of the base causes the second part of the plug to move relative to the first part from the first relative position to a second relative position. With the base inserted, and during rotation of the plug with respect to the receptacle to cause the base member to engage and lock behind the flanges, the first and second parts are held in their second relative position until a rotational position is reached when the blocks are able to, under the restoring force of the spring, enter the space between the facing edges of the flanges. At this point, the first and second parts reassume their first relative position with the contact pins contacting the current conductors under the force of the spring.

An advantage of this combination is that contact between contact pins and current conductors cannot occur until the final coupled position has been reached.

A further advantage is that the supporting blocks also serve to position the plug relative to the receptacle.

BRIEF DESCRIPTION OF THE DRAWINGS

The invention will be described in greater detail with reference to the drawing.

Corresponding parts in the various figures are referred to by the same reference numerals.

DESCRIPTION OF THE PREFERRED EMBODIMENTS

Figure 1:
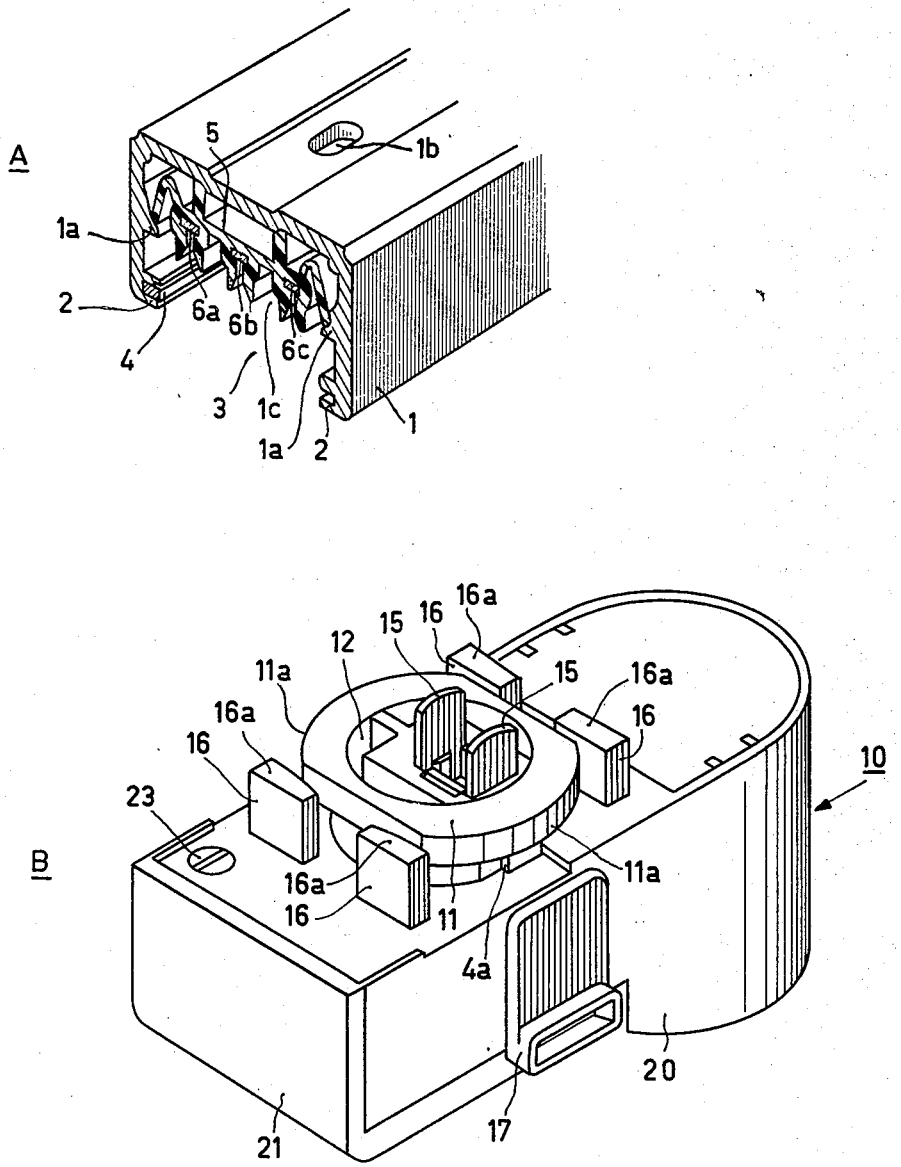
FIG. 1 (A and B) is a perspective view of a track receptacle and a plug according to the invention.

In FIG. 1, A denotes a track receptacle, in which 1 is an aluminium housing whose flanges 2 bound an opening 3 extending over current conductors **6*a*, 6*b*, and 6*c* in a longitudinal direction of the receptacle. The opening 3 gives access to the space 1*c* enclosed by the receptacle. A conductor 4**, for grounding the receptacle, is provided in one of the flanges.

A holder 5 of synthetic resin is clamped against one side of the aluminum housing by means of locking ribs **1*a*. Holder 5 is provided with three mutually insulated current conductors 6*a*, 6*b* and 6*c* at mutually equal distances. The central current conductor 6*b* lies in the plane of symmetry of the holder 5** of synthetic resin.

The receptacle can be secured, for example, to a wall or ceiling via an aperture **1*b* provided in the aluminum housing 1**.

The letter B denotes the plug, 10 denoting a first part of the plug, the plug housing. The first part 10 has a base 11 comprising projecting rims **11*a* on either side. The base 11 has a recess 12 through which contact pins 15 project. The base 11 further comprises two diametrically opposed contact points 4*a* one of which cooperates with the conductor 4** of the receptacle when coupled to the plug.

Together with supporting blocks 16, which each comprise a supporting face **16*a*, and grips 17, the contact pins 15 form part of a second part 18 (FIG. 2), a contact pin support of the plug. In the situation shown in FIG. 1 the second part 18 is in the first position relative to the first part 10**, the contact pins extending out of the recess in the base and the supporting blocks extending out of the recesses in the housing.

The first part 10 of the current collector has a cylindrical portion 20 to which a current-consuming device, for example a lamp, can be connected. A cover 21 is also connected to the first part by means of screw 23.

Figure 2:
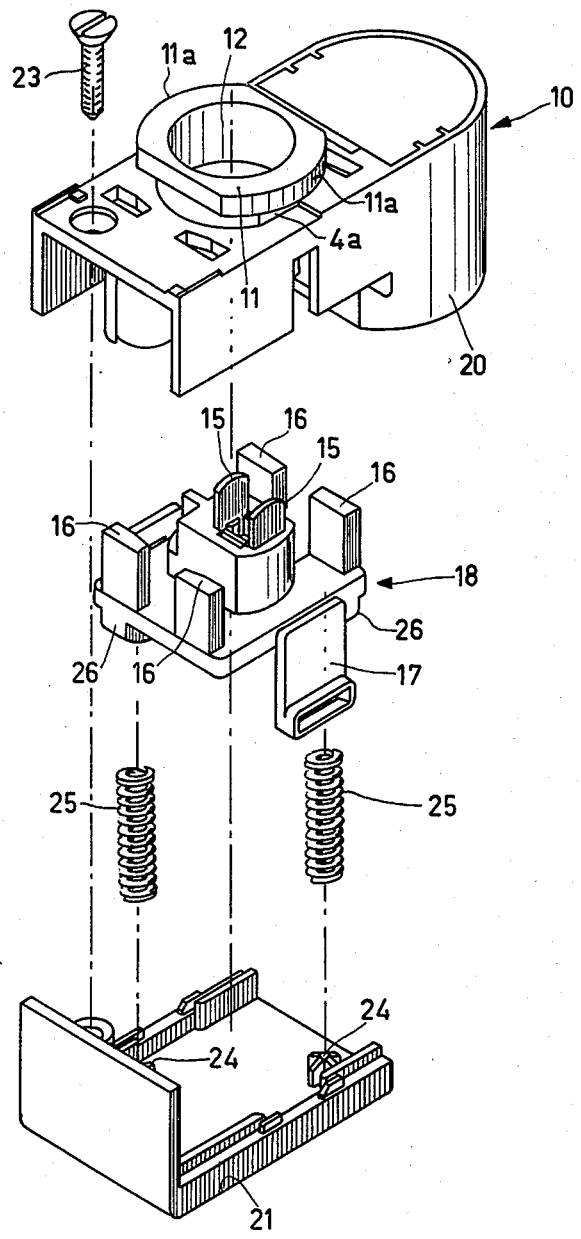
FIG. 2 is an exploded view of the plug.

In FIG. 2, which shows the construction of the plug B, it can be seen that the cover 21 has two supporting points 24 on which one end of springs 25 bear. The other ends of the springs 25 press against bosses 26 in the second part 18 of the plug. Since the cover 21 is secured to the first part 10 by screw 23, the second part 18 can be moved relative to the first part 10 against the force of the springs 25.

Figure 3:
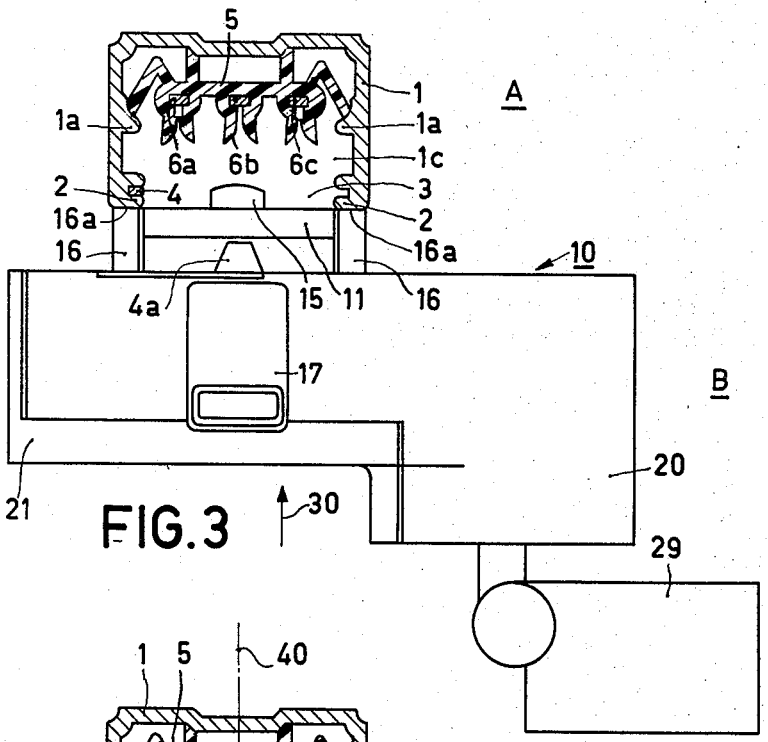
FIG. 3 is a cross-sectional view through the receptacle and an elevational view of the plug and lamp, in which the plug is placed in an initial position for coupling to the receptacle.
Figure 4:
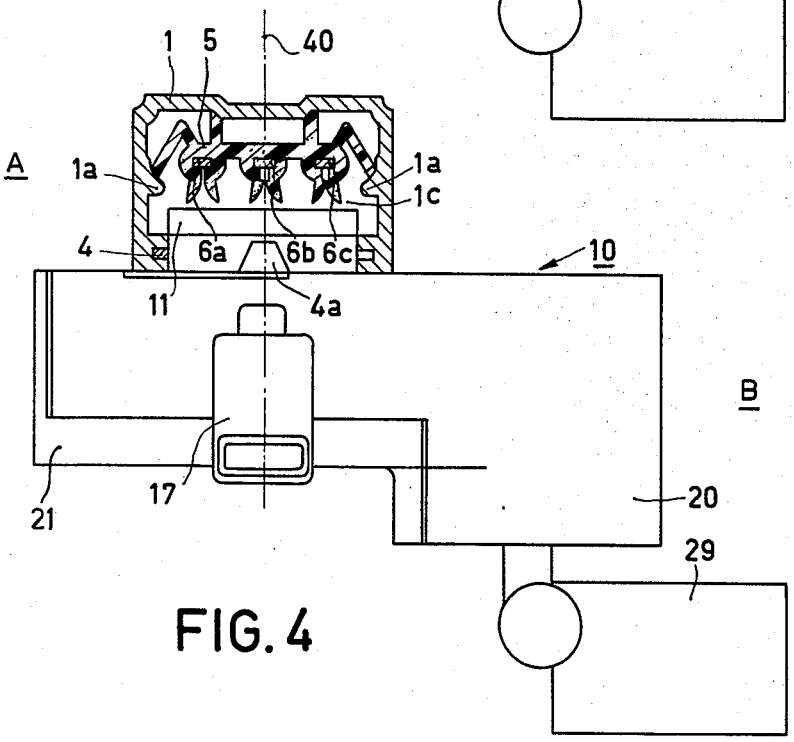
FIG. 4 shows the next step, from FIG. 3, for coupling the plug and lamp to the receptacle.
Figure 5:
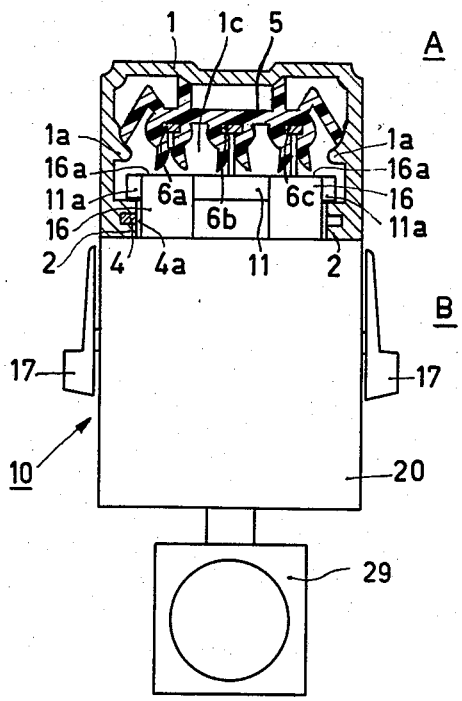
FIG. 5 is a cross-sectional view through the receptacle and an elevational view of the plug and lamp in the coupled condition.

The coupling of the plug B to the receptacle A will be explained in FIGS. 3 to 5. In FIG. 3, the plug is placed on the rail in an initial position in which the supporting faces 16*a* of the supporting blocks 16 bear on the flanges 2 of the receptacle. Both the contact pin support and the plug housing are oriented transverse to the longitudinal direction of the receptacle. The second part 18 of the plug is in the first position relative to the first part 10. A lamp 29 is connected to the first part 10 of the plug.

By moving the first part 10 of the plug in the direction denoted by the arrow 30, the second part 18 of the plug is moved to a second position relative to the first part 10. This situation is shown in FIG. 4. In this situation the base 11 is now projecting through the opening 3 into the space 1*c* enclosed by the receptacle A.

The plug B is then moved to a final position, the coupled position, by a rotating it through approximately 90° about axis 40 through base 11. Both the contact pin support and the plug housing are now oriented along the longitudinal direction of the receptacle. The coupled condition is shown in FIG. 5. In this coupled condition the second part 18 of the plug again assumes the first position relative to the first part 10, since blocks 16 now enter space 1*c* under the force of springs 25. The contact pins 15 now contact two current conductors 6*b* and 6*c*, while the supporting blocks 16 are substantially entirely within the enclosed space 1*c* and each closely fit one of the two facing edges of the flanges 2. As a result of this, further rotation of the plug B about the axis 40 is not possible. The projecting rims 11*a* of the base 11 cooperate with the flanges 2 in such manner that movement of the plug as a whole in a direction perpendicular to the receptacle is not possible. However, it is possible to slide the plug along the longitudinal direction of the receptacle.

For uncoupling the plug B, first the second part 18 will have to be moved against the spring force into the second relative position by means of the grips 17. The plug can then be rotated as a whole about the axis 40 to its initial position, after which the second part 18 will be moved by the spring pressure to the first position relative to the first part 10, during removal of the plug from the receptacle.

As a result of the asymmetric location of one of the contact pins of plug B it is also possible to couple the plug in a position rotated 180° about an axis perpendicular to the receptacle. The advantage of this is that the plug can be connected with one of its contact pins 15 to either one of the two conductors 6*a* and 6*c* which can be switched independently of each other, the conductor 6*b* constituting the common return current lead.

Although in this embodiment a plug has been described which is suitable for coupling to a receptacle having three mutually insulated current conductors, it will be obvious that the plug embodying the invention may alternatively be used in a receptacle having two or more than three mutually insulated current conductors.

Finally it is to be noted that in this embodiment a lamp 29 is connected to the plug by way of example. It is alternatively possible, however, to connect other types of current-consuming devices to the plug either directly or via an electric cable.

What is claimed is:

1. A detachable plug and receptacle for electrical connections comprising:

a track receptacle having at least two mutually insulated current conductors extending in a longitudinal direction, said receptacle enclosing a space which is accessable via a longitudinal opening over the current conductors, said opening being bounded by two flanges; and a plug, comprising:

a contact pin support having supporting blocks and at least two contact pins, said support being adapted to fit into the opening in the receptacle, with the contact pins engaging the current conductors, when said support is oriented in the longitudinal direction, said supporting blocks engaging the flanges and preventing the contact pin support from fitting into the opening in the receptacle and preventing the contact pins from engaging the current conductors whenever said support is not oriented in the longitudinal direction; and a housing having a base, said housing having recesses through which the supporting blocks project, said base having a recess through which the contact pins project, said contact pin support being slidably mounted in the recesses, said base having projecting rims on opposite sides such that when the housing is oriented transverse to the longitudinal direction the base can be inserted into the opening in the receptacle and such that when the housing is oriented along the longitudinal direction the projecting rims of the base engage the receptacle flanges to prevent removal of the plug through the opening in the receptacle;

said contact pin support being held in a first position in the housing by springs, the contact pins extending out of the base and the supporting blocks extending out of the housing in said first position;

whereby, when the base of the housing is inserted into the receptacle, the supporting blocks of the plug engage the flanges of the receptacle thereby moving the contact pin support against the springs into a second position in which the contact pins are withdrawn into the recess in the base and do not contact the current conductors; and whereby, when the housing is rotated substantially 90° about an axis through the base, the projecting rims of the base engage the flanges of the receptacle, the supporting blocks enter the receptacle, and the contact pin support reassumes the first position whereby the contact pins engage the current conductors.

2. A detachable plug and receptacle as claimed in claim 1, wherein, when the plug is coupled to the receptacle, the supporting blocks of the contact pin support prevent any substantial rotation of the plug in the receptacle.

3. A detachable plug and receptacle as claimed in claim 2, wherein said contact pin support further comprises grips slidably mounted in recesses in the housing, for manually moving the contact pin support into the second position in order to allow rotation of the plug relative to the receptacle to detach the plug from the receptacle.

4. A plug for detachable connection to a receptacle of the type having at least two mutually insulated current conductors extending in a longitudinal direction and having two flanges bounding a longitudinal opening providing access to a space over the current conductors, said plug comprising:

a contact pin support having supporting blocks and at least two contact pins, said support being adapted to fit into the opening in the receptacle, with the contact pins engaging the current conductors, when said support is oriented in the longitudinal direction, said supporting blocks engaging the flanges and preventing the contact pin support from fitting into the opening in a receptacle and preventing the contact pins from engaging the current conductors whenever said support is not oriented in the longitudinal direction; and a housing having a base, said housing having recesses through which the supporting blocks project, said base having a recess through which the contact pins project, said contact pin support being slidably mounted in the recesses, said base having projecting rims on opposite sides such that when the housing is oriented transverse to the longitudinal direction the base can be inserted into the opening in the receptacle and such that when the housing is oriented along the longitudinal direction the projecting rims of the base engage the receptacle flanges to prevent removal of the plug through the opening in the receptacle;

said contact pin support being held in a first position in the housing by springs, the contact pins extending out of the base and the supporting blocks extending out of the housing in said first position;

whereby, when the base of the housing is inserted into the receptacle, the supporting blocks of the plug engage the flanges of the receptacle thereby moving the contact pin support against the springs into a second position in which the contact pins are withdrawn into the recess in the base and do not contact the current conductors; and whereby, when the housing is rotated substantially 90° about an axis through the base, the projecting rims of the base engage the flanges of the receptacle, the supporting blocks enter the receptacle, and the contact pin support reassumes the first position whereby the contact pins engage the current conductors.

5. A plug as claimed in claim 4, wherein when the plug is coupled to the receptacle the supporting blocks of the contact pin support prevent any substantial rotation of the plug in the receptacle.

6. A plug as claimed in claim 5, wherein said contact pin support further comprises grips slidably mounted in recesses in the housing, for manually moving the contact pin support into the second position in order to allow rotation of the plug relative to the receptacle to detach the plug from the receptacle.

7. A plug for detachable connection to a receptacle of the type having at least one insulated current conductor and two flanges bounding an opening extending in a longitudinal direction, said opening having a given width and providing access to a space over the current conductor, said plug comprising:

a housing having an axially extending base;

a contact pin support having at least one contact, said support extending in an axial direction, means for mounting the contact pin support in the housing for limited relative movement along said axial direction between a retracted position and an extended position;

means for preventing insertion of the contact pin support into the opening between the flanges of the receptacle when the housing is oriented transverse to the longitudinal direction; and means for locking the housing to the track when the base of the housing is inserted into the track and the housing is aligned in the longitudinal direction;

wherein the base of the housing can be inserted into the opening between the flanges only when the housing is oriented transverse to the longitudinal direction.

8. A plug as claimed in claim 7, further comprising means for preventing insertion of the base of the housing into the opening between the flanges.

9. A plug as claimed in claim 8, further comprising means for spring biasing the contact pin support into the extended position.

10. A plug as claimed in claim 9, wherein said means for locking are formed by the base, said base having a width less than the given width of the opening and having opposed projecting rims which engage the flanges of the receptacle upon rotation of the housing to the longitudinal direction.

11. A plug as claimed in claim 10, wherein the base of the housing can be inserted into the opening between the flanges only when the housing is perpendicular to the longitudinal direction.

12. A plug as claimed in claim 10, wherein the means for preventing insertion of the contact pin support also prevent rotation of the contact pin support while said support is in the extended position in the opening between the flanges.

13. A plug as claimed in claim 12, wherein said means for preventing insertion of the contact pin support comprise at least one supporting block arranged to engage the receptacle flange when the housing is aligned traverse to the longitudinal direction, and to extend into the receptacle opening under the influence of said spring biasing means upon alignment of the housing in the longitudinal direction.

* * * * *